United States Patent [19]

Rast

[11] Patent Number: 4,949,653

[45] Date of Patent: Aug. 21, 1990

[54] PROCESS AND APPARATUS FOR INCINERATION

[76] Inventor: James P. Rast, 9510 Herring Hill Rd., Millington, Tenn. 38053

[21] Appl. No.: 446,880

[22] Filed: Dec. 6, 1989

[51] Int. Cl.[5] ..... F23D 14/00; F23G 5/00

[52] U.S. Cl. ..... 110/235; 110/255; 110/346

[58] Field of Search ..... 110/235, 346, 255, 233, 110/267, 101 R, 204

[56] References Cited

U.S. PATENT DOCUMENTS

| | | | |
|---|---|---|---|
| 2,912,941 | 11/1959 | Hughes et al. . | |
| 3,408,967 | 11/1968 | Maitilasso . | |
| 3,556,025 | 1/1971 | Holley . | |
| 3,626,461 | 12/1971 | Munk . | |
| 3,766,866 | 10/1973 | Krumm . | |
| 4,437,419 | 3/1984 | Hertel . | |
| 4,665,841 | 5/1987 | Kish . | |
| 4,750,437 | 6/1988 | Rouse | 110/346 |

FOREIGN PATENT DOCUMENTS 58-31214 2/1983 Japan .

*Primary Examiner*—Edward G. Favors

[57] ABSTRACT

An incinerator and recyclable material recovery apparatus and method for processing refuse. An incineration means is disclosed for loading and shaping a refuse mass on a refractory transport means and conveying the refuse mass through an incinerator to achieve ecologically acceptable combustion of combustible materials, melting and selective separation of metallic and glass components of the refuse mass and removal of non-combustible materials. The novel method and apparatus provides a refuse mass transport means having means to allow removal of water from the refuse mass during the pre-heat and combustion stages of incineration and provides a means to selectively remove glass and metallic portions of the refuse mass as the melting temperature of these materials are reached during the incineration process.

23 Claims, 6 Drawing Sheets

ALUMINUM ZONE
GLASS ZONE
COMBUSTION ZONE
REPAIR TRACK
STORAGE TRACK
REPAIR TRACK
STORAGE TRACK
TRANSFER TRACK
TRANSFER TRACK
DUMP STATION
93
40
40
39
20
4
18
16
14
10
60
53
48
46
43
45
90
91
90
62
31
31
30
29
28
27
26
25
24
23
22
21
20
19
18
17
16
15
14
13
12
11
10
9
8
7
6
5
4
3
2
1

PROCESS AND APPARATUS FOR INCINERATION

The present invention relates generally to a method and apparatus for the processing of solid waste materials, and more specifically, to the incineration of combustible materials and utilization of the heat of combustion to aid the separation of metallic and siliceous waste material by melting point fractionalization. The remaining solid residue of steel and ash is segregated at the terminus of the apparatus. The high temperature incineration of the present process limits the need for cleansing of the gaseous effluents from the process as is required in lower temperature incineration methods. The apparatus and method is particularly adapted to the disposal of municipal solid waste including medical solid waste and solid sludge from the treatment of sewage waste products.

It is recognized that the disposal of solid waste presents significant problems in the present urbanized society. Conventional means to solve the solid waste disposal problem are the usage of solid waste landfills which are environmentally unsound both as to inefficient land utilization and the impact of trash degradation and resultant seepage of toxic materials into the water table surrounding the landfill. Additionally, the low temperature incineration of solid waste is increasing in utilization, but is generally a batch type operation with the inherent inefficiencies of such operation and is conducted at temperatures which require cleaning of the gaseous effluents of the process or in the absence of such cleansing, the further pollution of the environment.

The use of continuous incineration processes for solid waste material is known as is evidenced by the U.S. Pat. No. 2,912,941 to Hughes et al. and U.S. Pat. No. 3,626,461 to Munk. The utilization of the heat of the combustion products in a batch, high temperature process is disclosed in U.S. Pat. No. 4,665,841 to Kish. Each of the foregoing methods of trash incineration and disposal do not provide the continuous processing and recovery of recyclable materials in the efficient and cost effective apparatus and method of the present invention.

SUMMARY OF THE INVENTION

It is therefore a feature of the present invention to provide a process and apparatus for the incineration and separation of recyclable trash components in a single operation utilizing a portion of the heat of combustion of the combustible materials present to aid in the melting phase separation of the non-combustible, recyclable materials present, including metallic materials and glass. The process and apparatus of the invention are particularly adapted to the incineration of conventional, non-separated municipal trash in a continuous firing and controlled temperature operation which promotes the stability of refractory materials forming the enclosure of the incinerator and limits their degeneration caused by temperature cycling while providing a controlled temperature for the heat transfer equipment and hence a constant source of heat transfer to heat recovery and utilization apparatus integral with or peripheral to the process.

It is another feature of the invention to provide an incineration and recycling process and apparatus which permits exterior repair of the refractory containment cars of the system without shut down of the system and a means for sealing the upper portion of the containment car structure from the lower portion of the car structure by a cooperating refractory side wall construction to contain the trash materials and heat in the upper portions of the incineration tunnel.

It is yet another feature of the present invention to provide high temperature incineration of municipal trash to preclude or limit the need for cleansing the gaseous effluents from the incineration process.

It is another and further feature of the invention to provide an incinerator construction which provides for automatic cleaning of the containment cars and automatic inspection of the tap hole means used to facilitate phase separation of the recyclable materials as the melting point of each material is reached.

It is yet another feature of the present invention to provide an economical process to obtain separated recyclable materials from an incineration process and apparatus which recyclable materials are recovered inherently sized by the process for facility of handling while utilizing the heat of combustion generated to further process the recyclable materials and utilize the super heated gases in the latter melting zones of the process to generate super heated steam for power generation.

Briefly, in its broader aspects, the present invention comprehends a unitary incineration and recyclable material recovery facility for continuous incineration of municipal waste materials, sludge from waste treatment plants and medical wastes, while utilizing the zonal control of temperature to separate recyclable materials by melting point during the process. The facility may best be described as a continuous tunnel kiln, preferably of circular configuration having hearth car means for containment of the municipal waste, the car means are driven through a kiln having zoned temperatures to incinerate combustible materials and realize the heat of combustion for further process utilization, and zonally melt and separate metallic and glass components of the waste material through tap holes placed in the cars for deposition in and collection from water filled containment means placed below the cars. The facility also provides means to load, shape and compact the waste material for incineration, means to place medical and sludge waste materials on the top of the compacted waste prior to incineration, gravity cleaning means for the hearth cars and a system for inspection, replacement and repair of hearth cars without interruption of the process.

Further objects, advantages and features of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS

Figure 1:
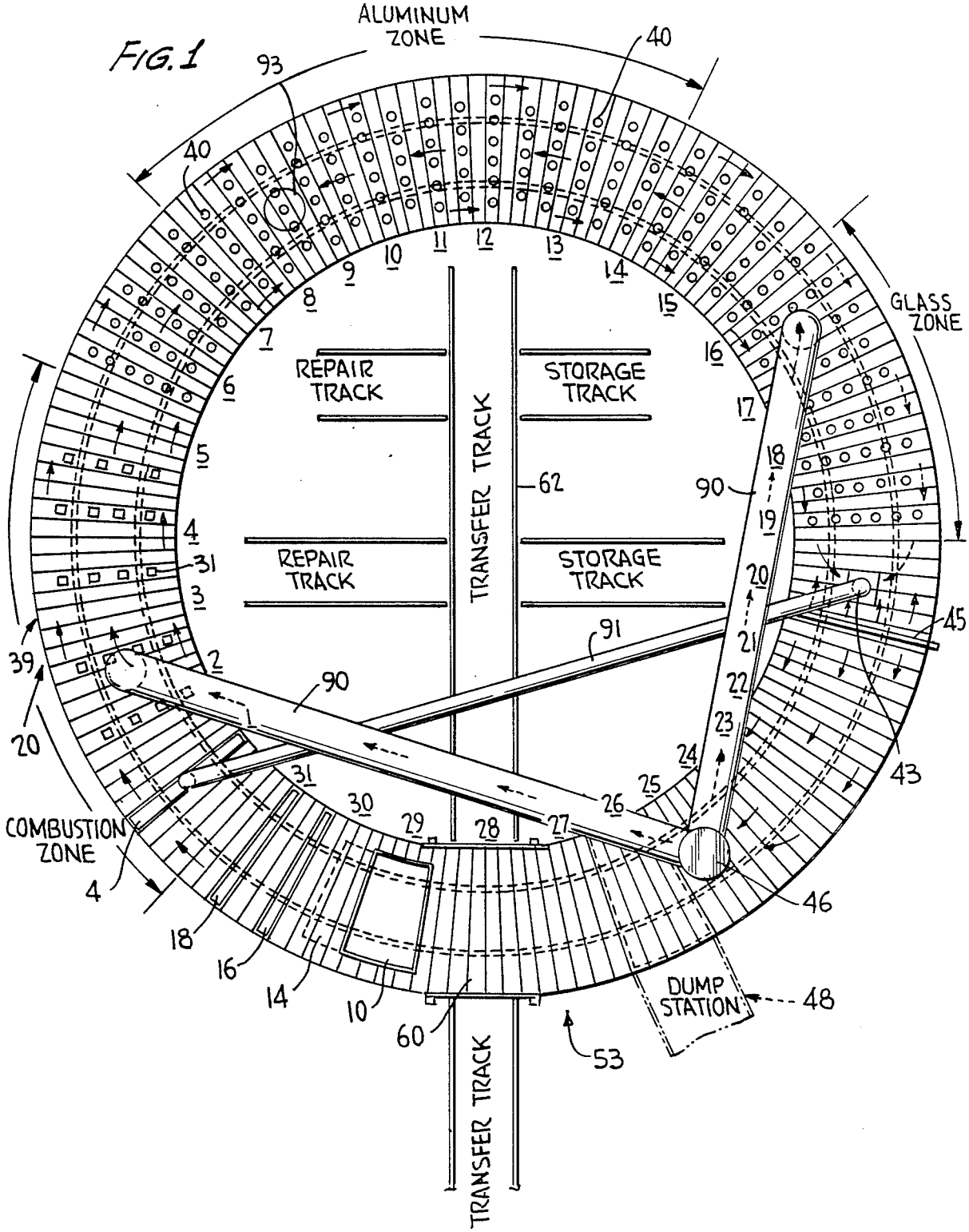
FIG. 1 is a plan view of one embodiment of the continuous, process and apparatus.

The plan view of one embodiment of the process and apparatus of the invention is presented at FIG. 1. The incineration and recycling apparatus discussed in this embodiment is intended to process the municipal trash of a city that generates approximately 500 tons of municipal trash a day. The inside diameter of the furnace would be approximately 100 feet and the incinerator tunnel width would be approximately 15 feet. In this configuration there would be approximately 31 containment hearths numerically presented at FIG. 1. An approximately three foot bed of trash would be placed upon the trash containment hearths allowing a clearance of approximately three feet between the top of the trash and the roof of the incinerator tunnel at the entry of the furnace. This spacing is necessary to facilitate slow combustion, i.e., "smoldering", of the combustible materials in the initial portion of the combustion section of the incinerator. The invention may be described by following the process and related apparatus from the trash loading area 10 through the entire incineration process terminating with the ash and steel residue separation and hearth inspection. As will be further discussed, means to inspect and replace damaged or inoperative trash containment hearths is also provided just prior to the trash loading area of the incinerator furnace.

Figure 5:
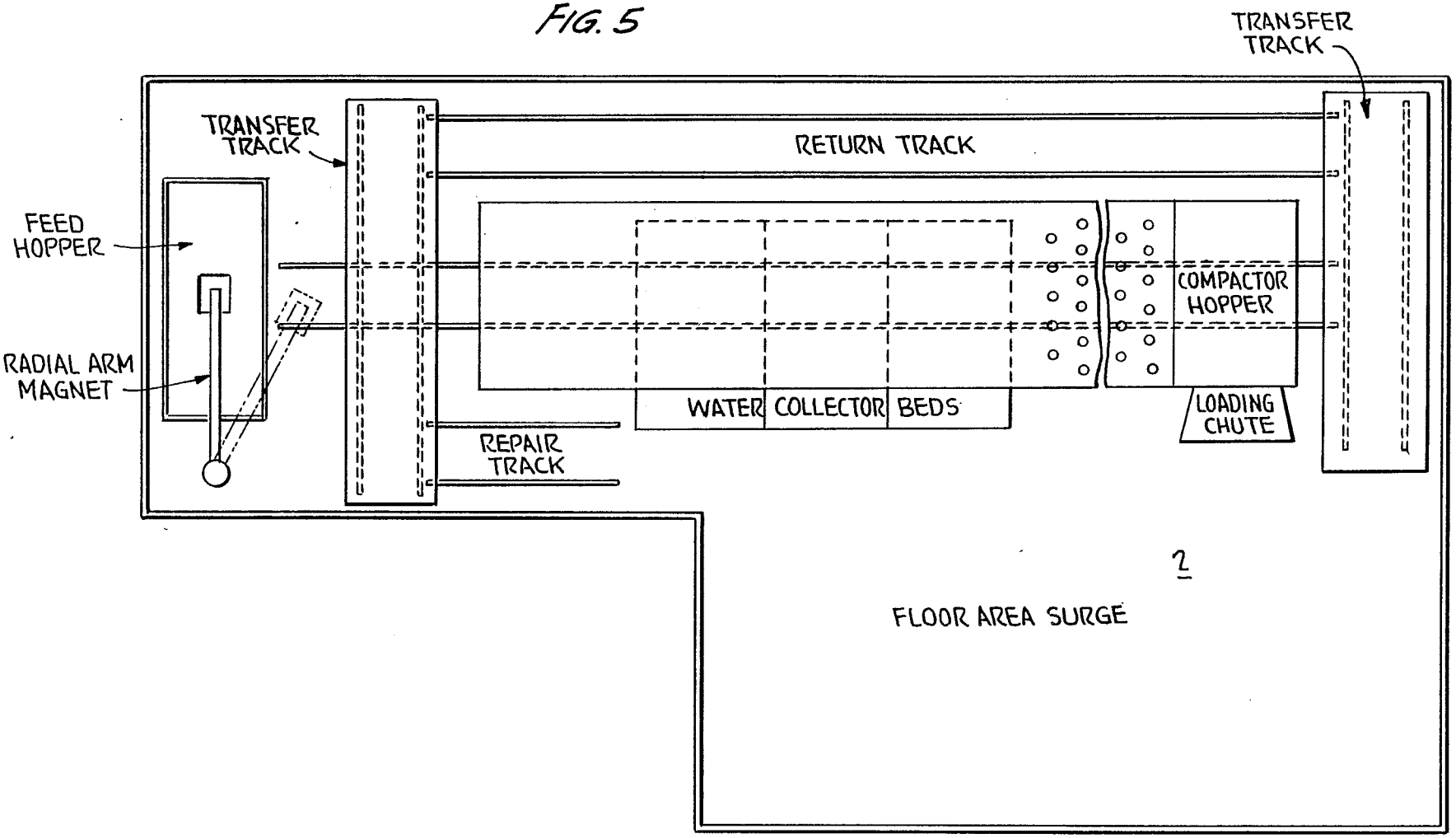
FIG. 5 is a schematic plan view of the straight line process configuration.

The trash is collected and deposited in a surge pit 2, see FIG. 5, or like area in close proximity to the loading area 10 of the incinerator. The trash is loaded by over head crane or like means into a charging hopper (not shown) which gravity feeds the trash onto trash containment hearths 12. The charging hopper is maintained in a trash full configuration to operatively seal the incinerator from the ambient air and to provide gravity feed of the trash to a lower shaping portion of the charging hopper comprising a shaping chute 14. The shaping chute 14, shown as dotted lines on FIG. 1, funnels and shapes the trash on the containment hearths 12. The shaping chute has a cover to control the height of the trash on the containment hearths to provide a trash depth of approximately three feet and side portions which funnel and shape the trash mass to provide space between the trash mass and the side walls of the incinerator furnace. The shaped trash mass after passing through the shaping chute 14 may be viewed at FIG. 2 and in cross section appears generally trapezoidal in shape. This shaping of the trash mass allows air and heat flow around three sides of the mass and hence heat penetration into the trash mass. This promotes both the expurgation of moisture from the trash mass and the combustion process.

Figure 2:
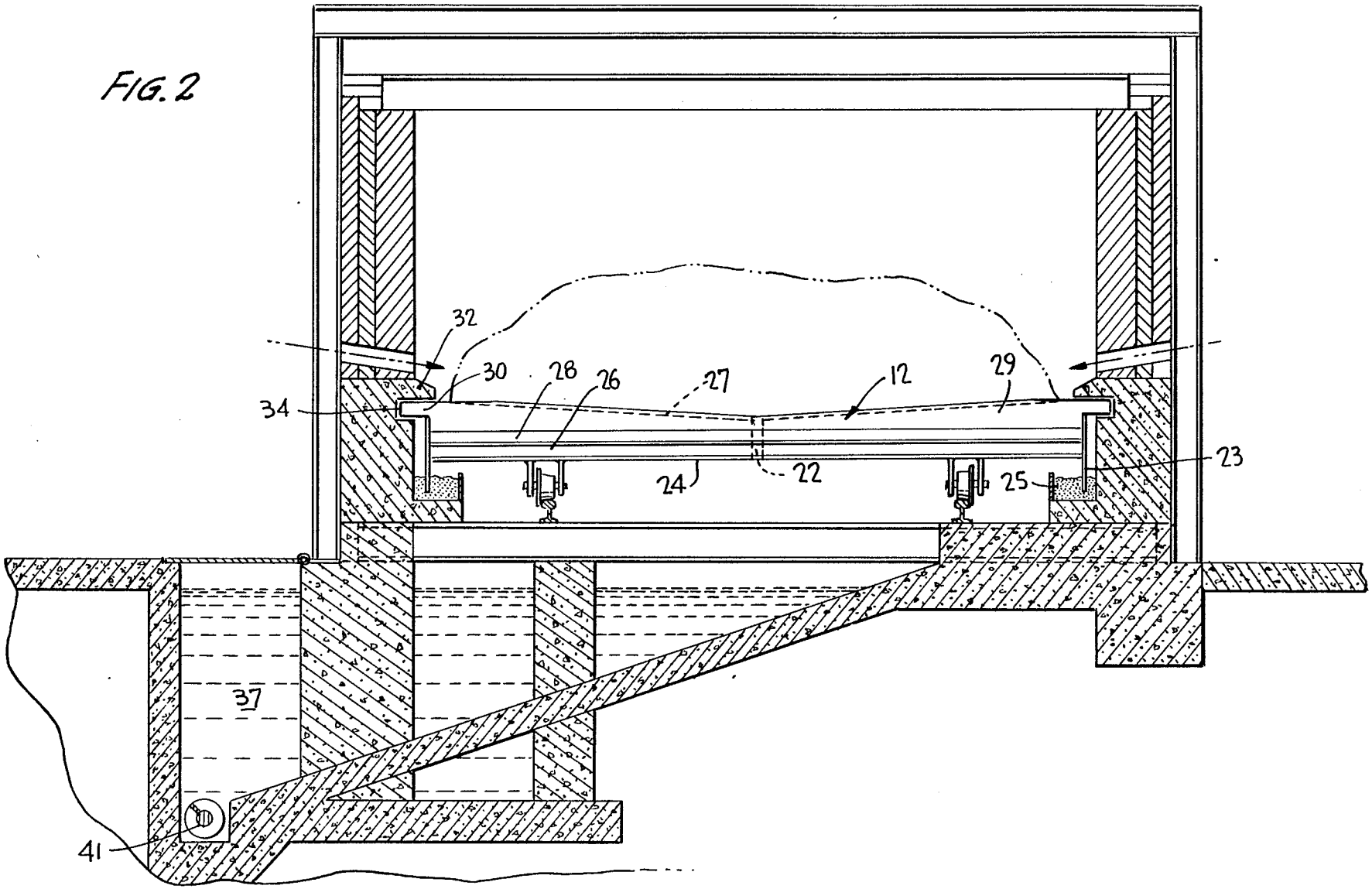
FIG. 2 is a front elevational view of a cross section of the incinerator of the invention.

The trash containment hearths 12 are pneumatically pushed forward from the loading area 10 by conventional means, not shown, e.g. hydraulic rams or like means used in conventional brick tunnel kilns, toward the combustion area 20 of the incinerator. The trash containment hearths 12, as best seen in FIGS. 2, present a refractory surface for support and containment of the trash through the incinerator furnace. Additionally, tap holes 22 are provided in the hearths 12 to allow the separation of meltable recyclable materials such as aluminum, metallic alloys, and glass as the temperatures for melting these materials are reached during the incineration and fractional separation process. The undercarriage of hearths 12 may be conventional tunnel kiln cars as used in the brick industry. The hearths 12 have a steel bed lower portion 24 to which the railway wheel under portion of the hearth 12 is attached. This bed portion may comprise 8 inch structural steel beams overlaid with a base metal portion, e.g. 20 gauge galvanized corrugated metal. Above the steel bed 24 is an insulating refractory layer 26 of fire brick or like insulating refractory. Generally, a refractory of 80 pounds per cubic foot in density and an upper temperature range of 1800 degrees F. will suffice for this insulating layer. Above the insulating refractory layer 26 is a layer 28 of dense refractory underlayment preferably, high alumina or like dense refractory material having an upper temperature range of about 2100 degrees F. The hearth surface layer 29 may be a high alumina content rammable or poured refractory having a thickness of approximately 6 inches presenting a smooth refractory surface. As presented at FIG. 2, the surface layer 29 of the hearth 12 is contoured from all sides to slope to the central portion of the hearth 12. The slope is required to promote flow of melted, recyclable materials to the tap hole 22 of the hearth 12. Additionally, veins, or flow paths 27 may be molded into the surface of layer 29 to promote flow of melted material toward the tap hole 22. These conduit like, half cylinder depressions in the surface may be formed by placing PVC pipe or conduit on the surface of the layer 29 just prior to application of the final one or two inches of rammable refractory and subsequent removal of the pipe after hardening of the rammable refractory surface.

It is essential for the efficient operation of the incinerator that the upper combustion and melting zones of the incinerator be sealed from the lower undercarriage and recyclable recovery containments of the invention. As is evident, such sealing prevents the escape of heat and gaseous effluents from the combustion and melting zones of the incinerator. The hearths 12 are disposed upon conventional railway tracks. The forward and rearward edges of the hearths 12 overlap as shown at FIG. 4. The hydraulic "pushing" of the cars through the incinerator maintains the forward and rearward edges of contiguous cars in compressive abutment operating to effect sealing of the heating zones of the incinerator from the lower portions of the furnace structure. As will be appreciated, although not shown in the plan view of the hearths at FIG. 3, the hearths are slightly trapezoidal in shape to conform to the arc of the kiln structure. The steel under structure 24 of the containment hearth is provided with a metal skirt 23 which cooperates with a sand trough 25 to further seal the upper high temperature portions of the incinerator from the lower undercarriage areas of the incinerator.

To provide an additional seal to prevent escape of heat from the upper portions of the incinerator and to prevent trash from gathering below the hearth bed area, a flange portion 30 of the surface refractory material 29 projects outwardly of the edge of each hearth 12. This flange 30 cooperates with a sloped portion of the incinerator side wall 32 and a recess in the refractory side wall 34 to effect both sealing and trash positioning.

The trash is maintained in a surge pit 2 (see FIG. 5) located in close proximity to the loading area 10. The trash is placed in shaping chute 14 shown in schematic in FIG. 1. At the exit of the chute the trash is deposited on the hearths 12 at a depth of approximately 3 feet and shaped to have a generally trapezoidal cross section as presented in FIG. 2. This is accomplished by provided a funnel-like configuration to the chute in its lower extremities to compact and funnel the trash into this configuration. The upper loading area of the loading chute (not shown) may be a conventional hopper structure to provide a means for charging of the trash to the shaping chute 14. The loading and shaping chutes are maintained in a loaded condition to seal the incinerator from the ambient air and provide a significant pressure at the lower portions of the shaping chute to facilitate compaction of the trash mass.

Prior to the entry of the hearth 12 into the combustion area 20 of the incinerator, two loading openings are provided after the loading and shaping chute 14 to allow the dispersal of sludge and medical waste on the shaped trash mass. As presented a FIG. 1, the opening 16 is provided for the gravity feeding of sludge onto the top of the trash mass. This sludge may be derived from a water treatment or sewage facility located in proximity to the incinerator. This provides an environmentally sound and efficient means to process such sludge. A second opening 18 is provided in the roof of the incinerator prior to the combustion zone 20 to allow dispersal of medical waste on the top of the shaped trash mass. Conventional gravity feed chutes may be utilized with openings 16 and 18 to disperse the sludge and medical trash on the shaped trash mass. Charging apparatus at the lower portion of the gravity feed chute, not shown, such as a rotatable charging wheel having a plurality of receptacles are provided to charge the sludge and medical waste while maintaining closure of the incinerator from the ambient environment. This means of charging also provides means to meter the amount of sludge and/or medical waste deposited upon the trash mass.

After deposition of the medical waste, the hearth 12 enters the combustion zone 20 of the incinerator. In this zone the water is expurgated and combustion of the combustible materials present in the trash is initiated. Generally, flat flame roof burners 31, such as conventionally used in rotary hearth forging furnaces, may be used. As shown in the configuration of FIG. 1 approximately 20 flat flame burners would be used to provide additional heat to promote both drying of the trash mass and facilitate combustion of the combustible portion of the trash mass. The use of flat flame burners in the introductory combustion area 20 promotes the flow of gases in and about the trash mass and tends to cleanse the roof structure and prevent deposition of soot, ash and like residuals on the roof and side wall structure of the incinerator. To avoid explosions due to flash combustion of partially burned combustibles gaseously entrained in the combustion area, it is preferred to maintain a positive pressure, low oxygen atmosphere in the combustion zone. To provide this environment, a portion of the high temperature exhaust gases from induction duct 43 is ducted via conduit 91 to the foremost area of the initial combustion zone just downstream of the medical waste opening 18 and introduced directly into the combustion zone using conventional injection duct 4 and associated conventional injection nozzles. This provides a high temperature, positive pressure input of low oxygen containing gas into the combustion zone. The low oxygen content prevents flash combustion of entrained combustibles while the positive pressure promotes movement of the combustion gases and entrained combustibles downsteam toward the high temperature melt zones of the incinerator. The temperature at the entry of the combustion zone 20 is approximately 400 degrees F. As may be understood, the hearths 12 retain heat which is conveyed to the trash mass during the loading and shaping process. Additionally, burners are provided in all areas of the incinerator where necessary to prevent the temperature from falling below about 350 degrees F. to prevent refractory damage to the hearths 12 due to refractory phase transformations at lower temperatures. This maintenance of minimum temperature prolongs the useful life of the refractory structure of the hearths 12 and promotes the economies inherent in long refractory life and lower replacement and repair costs.

A moisture collection containment 39 is disposed below the introductory portion of the combustion zone 20 to collect the water and moisture which drain out of the tap holes 22 of the hearths 12 during the early heating and trash combustion stages of the incineration process. The temperature at the exit of the combustion zone 20 is approximately 1000 degrees F. The heat of combustion and gases evolved during the combustion process are drawn downstream into the melt zones of the incinerator by one or several induction fans (not shown) which may be roof mounted in the furnace downstream of the combustion zone and, specifically at the end of the glass melting zone just prior to the direct cooling zone as depicted at induction fan duct 43 of FIG. 1. Placement of additional induction fans (not shown) in the incinerator recognizes the possible requirement of a plurality of induction fan ducts to promote desired gas effluent flow and maintain appropriate pressures during the incineration and melting point fractionalization process.

The induction fan duct 43 located at the end of the glass melting zone is provided with an induction fan (not shown) which is actually placed on the cool side of a heat exchanger or waste heat boiler. The heat exchanger or waste heat boiler may be used to provide super heated steam to peripheral power generation means or like utilization of the waste heat by peripheral apparatus. As noted earlier a portion of these high temperature, low oxygen content exhaust gases from duct 43 may be conveyed to the combustion zone via conduit 91 to provide low oxygen content, high temperature gases and promote a positive pressure input at injection duct 4.

As noted, depending upon the size of the incinerator facility, a plurality of induction fans may be required to provide a means to control the effluent gaseous flow from the combustion zone to the higher temperature "sweating" zones of the incinerator furnace. The preferred gaseous flow is depicted a FIG. 1 by the outer and inner periphery arrows. The presentation of the effluent stream of combustion gases to temperatures of 2000 degrees F. and above effectively cleanses the effluent stream by oxidation of the toxic effluents, particulates, vapors, and the like which are entrained in the effluent stream. This markedly reduces the gaseous effluent treatment necessary to reside within EPA, state, or like regulations relating to gaseous effluent treatment. Additionally, the heat of combustion realized in the combustion zone 20 is drawn downstream to lessen the external input of energy necessary to raise the temperatures in the melting zones to 2000 degrees F. and above. As presented at FIG. 1, the induced flow of gases within the incinerator is depicted by the arrows closest to the periphery of the incinerator walls.

Generally, the melting zones of the incinerator are divided into two melt collection areas, the aluminum and metallic alloy zone and the glass zone. While not shown in the preferred embodiment, it is possible to add a third steel melting zone to provide melting of steel residuals. The temperature of this zone would have to reach 2800 to 3000 degrees F. and refractories appropriate to these end use temperatures would have to be provided as the hearth material and in this region of the incinerator. As shown at FIG. 1 throughout the melting zones high velocity roof mounted burners 40 are provided. In the configuration shown at FIG. 1, approximately 180 high velocity burners are disposed six abreast in the melting areas of the incinerator. These high velocity burners are used in the melting zones of the incinerator to promote penetration of the heat into the remainder of the trash mass, to burn off any residual combustibles and assure heat soaking to promote complete melting of each of the recyclable constituents of the trash mass. The aluminum and metallic alloy zone of the incinerator encompasses temperatures of 1000 to 1650 degrees F. At the temperature range of 1000 to 1350 degrees F., the aluminum present in the trash mass is melted and drained through tap holes 22 directly into a water filled collection containment 37. The aluminum melt upon impacting the water in the containment 37 is beaded and collected at the outer periphery of the collection containment. As shown in FIG. 2, the bottom of the containment is sloped to facilitate gravity feed of the beads of metal toward the periphery of the containment. Although not shown in FIG. 2, the sloped walls of the containment 37 may be contoured to present V shaped channels to facilitate beading of the melted metals. As an example, convention angle iron could be disposed upon the walls to facilitate the beading process. The metallic alloys melt at the higher temperatures of the zone, e.g., about 1350 to 1650 degrees F. As with the aluminum, the alloys present in the trash mass is melted and drained through tap holes 22 into a water filled collection containment. Upon impacting the water of the containment the metallic melt beads and is collected at the outer periphery of the containment. It will be appreciated that the collected metallic beads are a mixture of all metals melting in the zonal temperature range. It may be desirable to prevent the steam generated in the beading process from invading the area of the kiln. To avoid this, a slotted covering may be placed over the containment. The slot being of sufficient width to accommodate flow of the melt from the tap holes 22 with provision of blowers or the like to displace the generated steam to the ambient environment.

Lastly, the trash mass enters the glass melting zone. The temperatures in the glass melting zone range from 1560 to 2200 degrees F. As with the prior recyclable melts, the melted glass is drained through tap holes 22 in hearths 12 into a water filled glass collection containment. The melted and resolidified glass is collected and may be used as cullet in conventional glass manufacture. As depicted in FIG. 2, the periphery of the containments 37 are provided with an auger pit 41 to facilitate transport of the recyclable material to a bucket elevator (not shown). Each of the recycling containments 37 are separate to prevent cross-contamination of the recovered materials. As noted earlier, a higher temperature zone may be provided to facilitate melting of steel present in the trash mass. However, to achieve the gaseous cleansing inherent in this high temperature incineration process, temperatures of 2800 to 3000 degrees F. are not required.

The control of temperatures in tunnel kilns and furnaces is well known. The controls for the monitoring and control of the temperatures in the combustion zone and various melting zones may include pyrometers, thermocouples and like devices and are used as needed to monitor and control the temperatures, atmosphere and pressures in the individual zones of the incinerator. The incinerator may be provided with air nozzles to support combustion and promote turbulence in the latter portions of the combustion zone 20 and in other areas of the incinerator to promote the flow of effluents from the combustion zone 20 into the higher temperature melting zones of the incinerator and oxidation of effluent gases and particulates.

An air curtain 45 is provided after the glass melting zone about six hearth lengths or approximately 28 to 30 feet past the last row of high velocity burners 40 in the incinerator. As presented in FIG. 1, the air curtain is disposed downstream of the induction fan duct 43 leading to a conventional heat exchanger and induction fan. The pressure of the air curtain will be balanced by an exhaust fan 46 placed upstream of the ash and residue dumping station indicated at 48 of FIG. 1. The exhaust fan 46 and associated ducting 90 will convey a portion of the heated exhaust gases to the burners 31 and 40 in the incinerator to promote greater efficiency of the burners by providing a supply of preheated air to the air injection nozzles of the burners. The internal arrows at FIG. 1 demonstrate the flow of preheated air to the burners 31 and 40 by conventional ducting (not shown), which arrows converge at pressure relief stack 93. It will be understood that several pressure relief stacks may be required depending upon the specific process parameters and the the size of the incinerator apparatus.

The ash, and residue on the hearths 12, which may comprise ash steel and like incombustibles that do not melt at the temperatures reached in the incinerator, are removed by dumping. As schematically shown in FIG. 4, this dumping of the residue is accomplished by displacing the hearth 12 from the horizontal to an incline position angle of approximately 45 degree or more. The dumping system utilizes a ring gear and pinion 54 in cooperation with a tiltable rail bed to tip the hearth forwardly to allow the ash and residue to fall through an opening disposed below the track. As shown at FIG. 4A, the hearth may be retained on the rail bed by retractable pawls 57 or like means which cooperate with the lower steel structure of the hearth to retain it in position on the tiltable rail bed.

The residue is gravity fed to a grate structure 49. The larger pieces of residue, e.g., steel and like high temperature melting metals, are retained on the grate and collected. The ash falls through the grate and is conveyed to a collection and storage area by conveyor means 51. The ash may also be conveyed under a magnetic means (not shown) to assure separation of smaller pieces of steel from the ash residue. The ash, which will be free of glass and metals, may be used for "sanding" streets, as an additive to concrete or simply disposed of in a sanitary landfill. The ash is inert and nontoxic therefore its use as a grading material or landfill does not present any environmental concerns. The larger pieces of non-combusted materials, generally steel are conveyed by slide plate 52 to conveyor 55 for collection and disposal.

After the hearth 12 is dumped, it is conveyed over an inspection station 53 to assure that the tap holes 22 are open. As shown at FIG. 3A, the inspection area 53 may simply comprise a light source 71 disposed below the hearth 12 and an associated photoelectric cell 73 disposed above the hearth 12. When properly positioned, the receipt of the beam from below the car through the tap hole 22 will indicate that the hearth tap holes are open. In the event the beam is not received, indicating blockage of the tap hole 22, the hearth 12 will be scheduled for removal from service. Additionally, a sight inspection of the hearths 12 may be undertaken in this area by visual inspection or remote camera to determine the condition of the hearth. Replacement and/or repair of the hearth, if required, is accomplished at the car transfer portion 60 of the incinerator.

Figure 3:
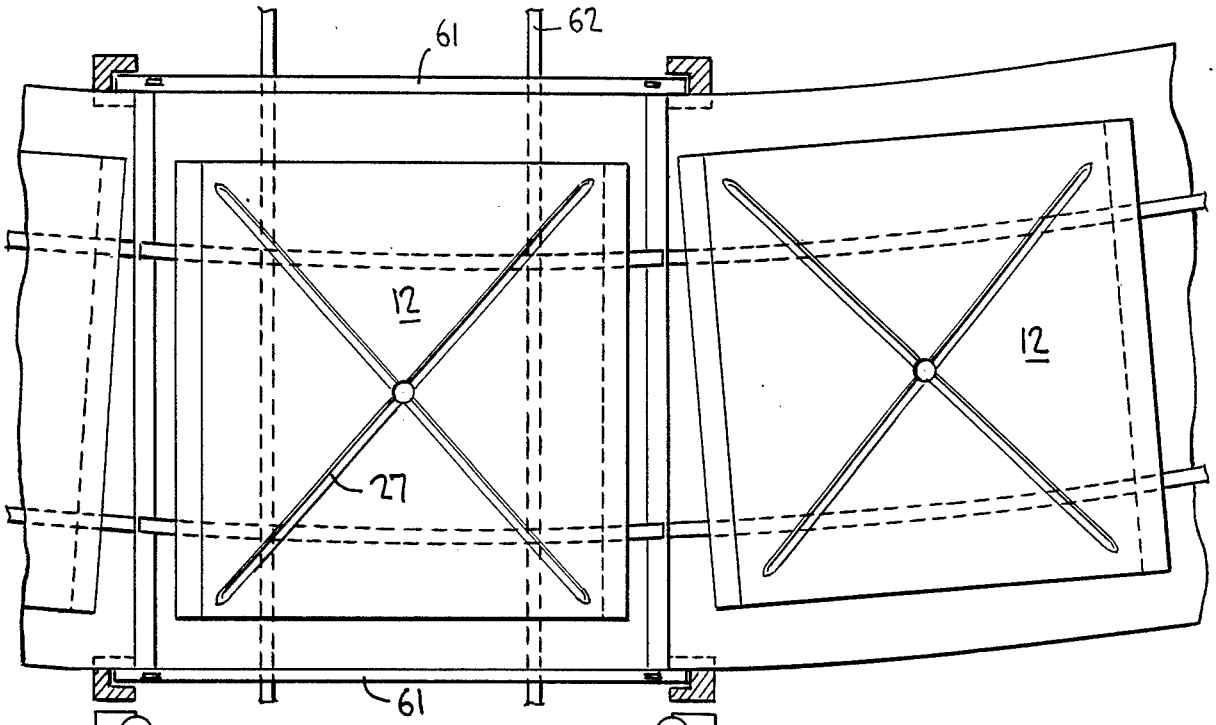
FIG. 3 is a cross sectional plan view of the trash containment hearth transfer area of the apparatus.
Figure 3A:
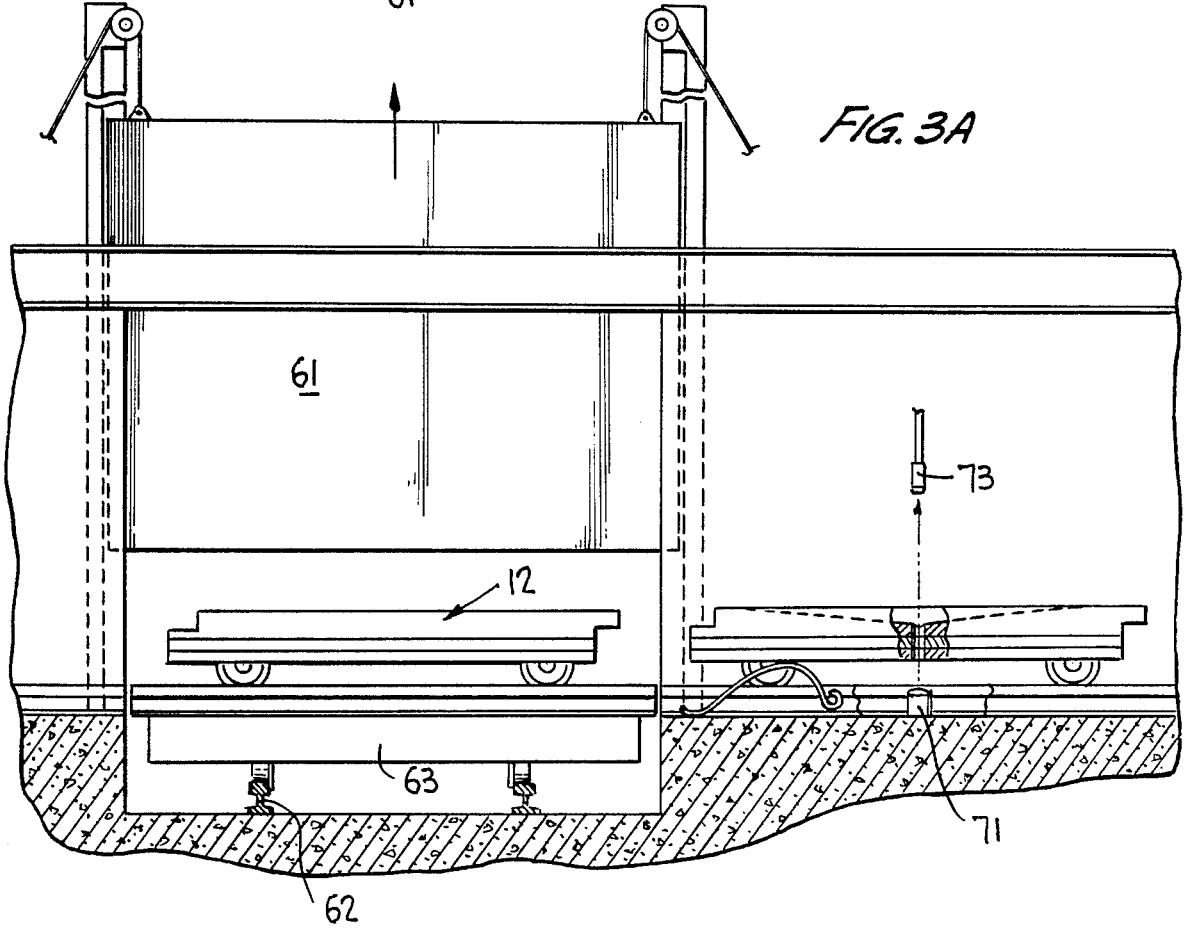
FIG. 3A is a side elevational view of the trash containment hearth transfer area of the apparatus.
Figures 4, 4A:
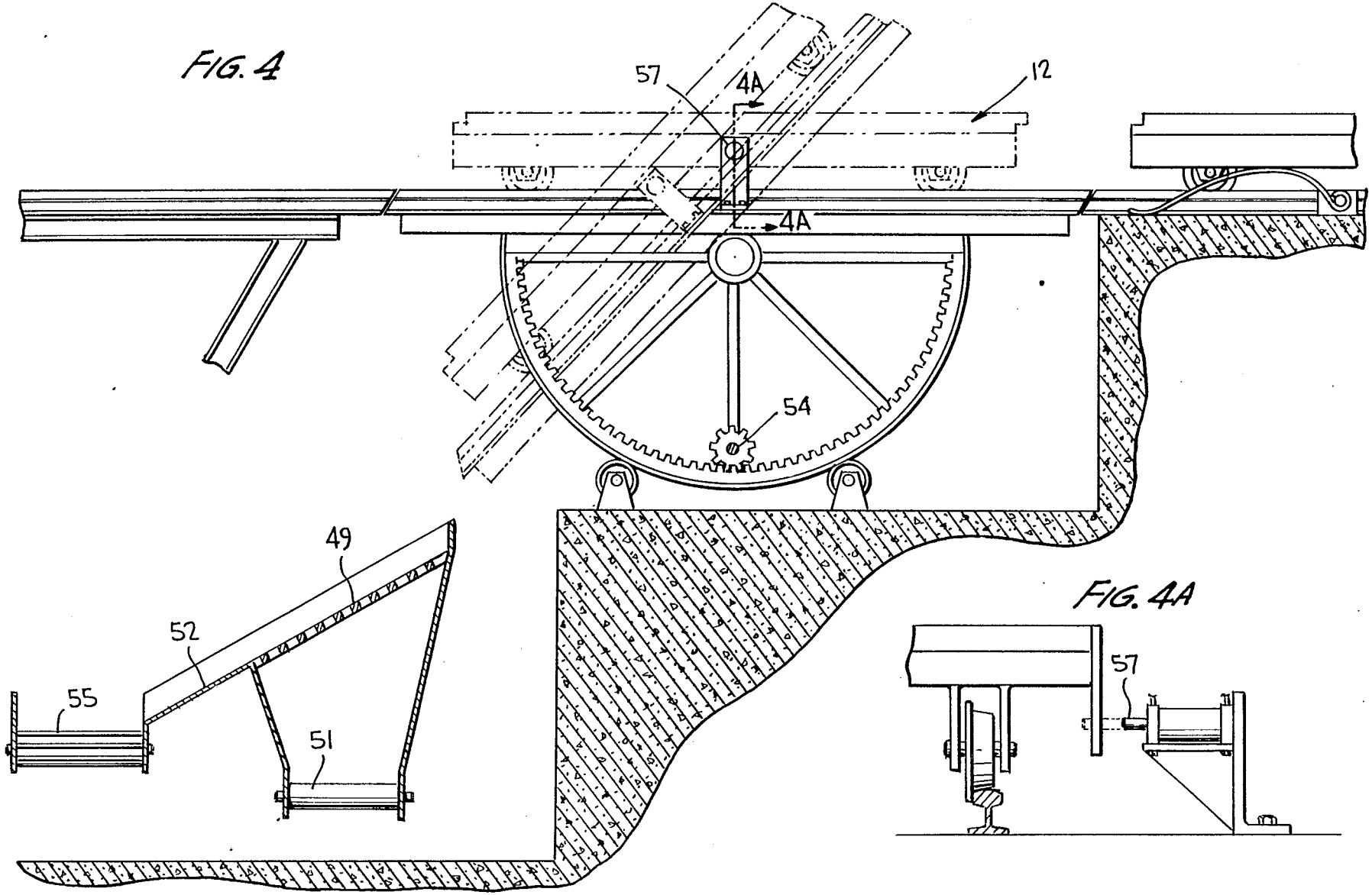
FIG. 4 is a side elevational view of the ash and residue dumping portion of the apparatus.
FIG. 4A is one embodiment of the holding means used to secure the trash containment hearth at the dumping portion of the apparatus.

As presented at FIGS. 3 and 3A, the hearth car transfer area of the incinerator, indicated at 60 of FIG. 1, is provided with guillotine doors 61 to allow access to a hearth requiring replacement or repair. The transfer track and hearth repair area is best viewed in FIG. 1. The transfer track 62 allows removal of the hearth to a repair area with may be located within the circular area defined by the incinerator structure. The transfer track also allows the replacement of the removed hearth with a new or repaired hearth. A transfer car 63, is disposed upon transfer track 62 and when in place provides the portion of rail track in the hearth car transfer area 60. When a hearth 12 is to be replaced, the transfer car 63 displaces the entire structure inwardly on track 62 toward the repair area . A like transfer car 63 is conveyed on track 62 to immediately replace the removed hearth and car under structure to allow limited interruption to the continuity of hearth movement within the incinerator. The transfer car 63 and its integral rail section will remain in position as the portion of incinerator track in transfer area 60 until another hearth replacement is required at which time the guillotine door 61 will be lifted and the hearth 12 will be removed for immediate replacement. As is evident from FIG. 1, the interior portion of the incinerator area is utilized to repair the hearths as required. Conventional track switching means is utilized in this area to promote efficient handling of the hearths 12.

Figure 6:
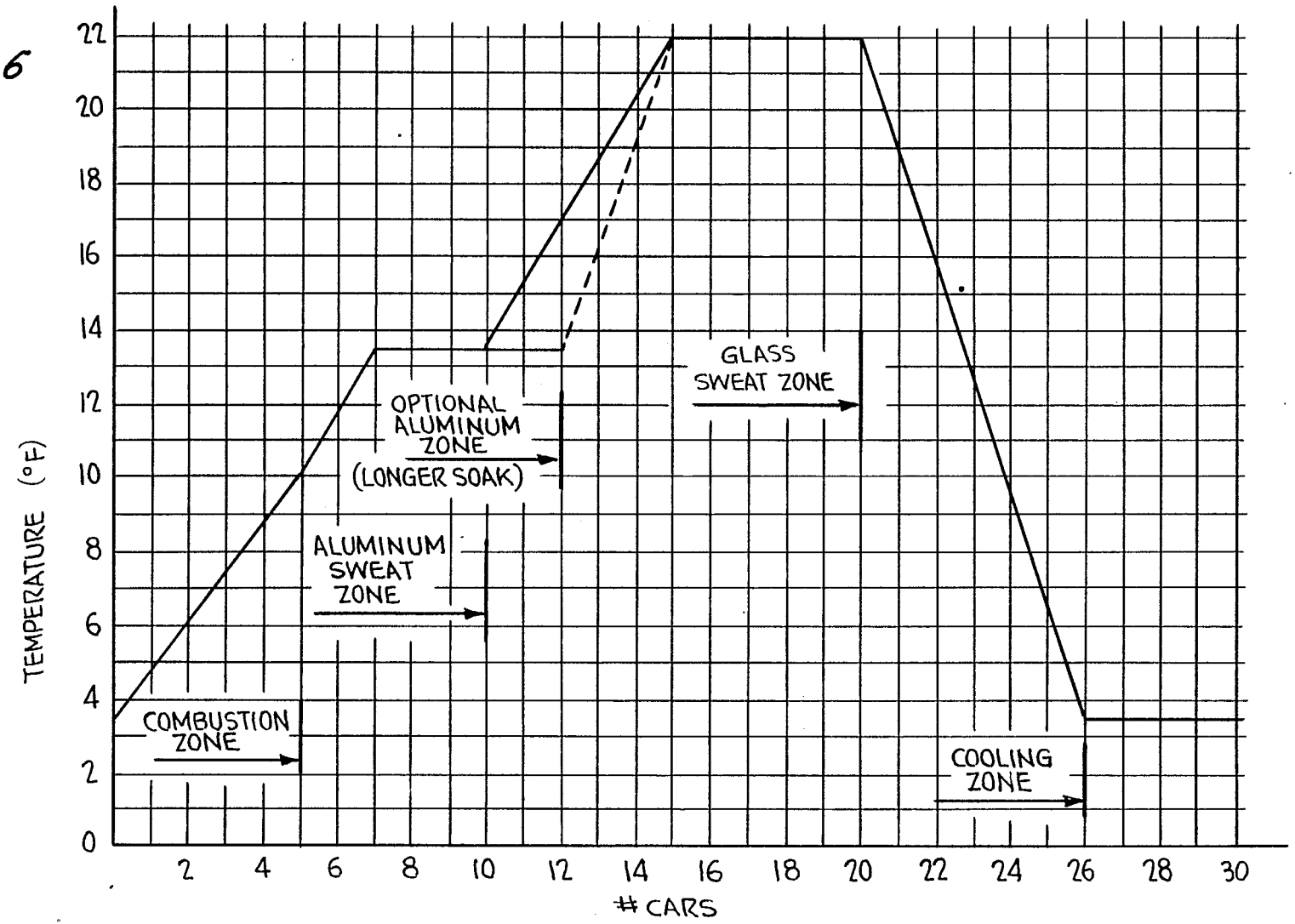
FIG. 6 is a temperature profile of the process by incinerator location.

The incinerator construction is conventional and analogous to brick or porcelain tunnel kilns. The type of refractory used at the internal surfaces of the incinerator will vary depending upon the refractory surface temperatures to be achieved in the area of use, the fluctuation range for such temperatures, the atmospheric conditions and like parameters impacting the structural stability, spall resistance and like performance factors for refractory materials. Generally lower temperature smooth surfaced refractory material is used in the combustion zone of the incinerator. The melting zone refractories generally vary from lower temperature alumina refractory materials in the early melt zones to high density alumina refractories in the high temperature, glass melting zone of the incinerator. The general temperature profile of the incinerator is presented at FIG. 6. The outside structure for the incinerator may be conventional structural steel and insulating refractory brick conventional in brick and porcelain kilns.

The embodiment, presented at FIG. 1, relates to an incinerator of circular configuration. As shown in FIG. 5, the incinerator apparatus may be of a straight line configuration. The schematic presentation of FIG. 5 demonstrates the use of such a straight line incinerator configuration. The primary difference between the straight line and circular embodiments of the invention is the transfer of the hearths 12 from the end of the straight line incinerator back to the front entry area of the incinerator. This transfer does allow greater cooling of the hearths 12 which is undesirable both from a refractory stability standpoint and the desirability of retaining as much heat as possible in the hearth 12. The hotter the hearth, the greater the reduction of moisture content to the trash at the loading and compaction areas of the incinerator.

While there has been shown and described what is believed to be the preferred embodiments of the present invention, it will be apparent to those skilled in the art to which the invention pertains that various changes and modifications may be made wherein without departing from the invention as defined in the appended claims.

I claim:

1. An incinerator and recyclable material recovery facility for the processing of a refuse mass comprising:

(a) an incineration means comprising a refuse loading area, a combustion area for the incineration of combustible materials in the refuse mass; a recyclable recovery area for the melting and selective collection of metallic and glass components of the refuse mass; and a residue disposition means for the removal of non-combustible ash and materials having a melting point higher than the temperatures reached in the incineration means;

(b) means to transport the refuse mass in the incinerator said transport means comprising a movable refuse mass support surface having means to allow the removal of melted components of the refuse mass;

(c) means to convey the said transport means in the incinerator;

(d) means to provide additional heat to the incinerator in excess of the heat generated during combustion of the combustible portion of the refuse mass; and (e) means to convey the gaseous and particulate combustion products from the said combustion zone to the said recyclable recovery area of the incinerator.

2. The incinerator and recyclable material recovery facility of claim 1 wherein the temperatures in the said recyclable recovery area of the incinerator range from about 1000 degree F. to 2200 degrees F.

3. The incinerator and recyclable material recovery facility of claim 1 wherein the temperatures in the said combustion area of the incinerator range from about 300 degrees F. to 1000 degrees F.

4. The incinerator and recyclable material recovery facility of claim 1 wherein the said residue disposition means comprises means to position the refuse mass support surface of the said transport means to allow gravity removal of the said residue from the said support surface.

5. The incinerator and recyclable material recovery facility of claim 1 wherein the said transport means comprises a hearth of refractory material and the said refuse mass support surface of the said transport means is configured to facilitate the flow of melted material to an opening in said surface, the said opening communicating with a collection means for the deposition of the flow of said melted material.

6. The incinerator and recyclable material recovery facility of claim 5 wherein the said opening is a tap hole communicating with a water filled containment disposed below the said transport means.

7. The incinerator and recyclable material recovery facility of claim 1 herein the said means to convey the said transport means in the incinerator is a railway track with cooperating wheels disposed upon a substrate support for the said refuse mass support surface.

8. The incinerator and recyclable material recovery facility of claim wherein the said refuse mass support surface is comprised of a monolithic refractory.

9. The incinerator and recyclable material recovery facility of claim 1 wherein the means to provide additional heat to the incinerator are a plurality of flat flame burners disposed in the combustion zone of the incinerator and a plurality of high velocity burners disposed in the recyclable recovery area of the incinerator.

10. The incinerator and recyclable material recovery facility of claim 1 wherein the means to convey the gaseous and particulate combustion products from the said combustion zone to the said recyclable recovery area comprise an induction fan disposed between the said recyclable recovery area and the residue disposition means.

11. The incinerator and recyclable material recovery facility of claim 10 wherein the gases exhausted by the induction fan are transported to a heat exchanger.

12. The incinerator and recyclable material recovery facility of claim 11 wherein the induction fan is disposed on the cool side of the said heat exchanger.

13. The incinerator and recyclable material recovery facility of claim 1 wherein removal and replacement means are provided for the removal and replacement of said transport means, said removal and replacement means comprising a transfer carriage which is affixed to and transports the said transport means to and from the structural confines of the incinerator and a repair area located outside the structural containment of the incinerator.

14. The incinerator and recyclable material recovery facility of claim 1 wherein the said refuse loading area has compacting and shaping means to compact and shape the refuse mass on the said refuse mass support surface.

15. The incinerator and recyclable material recovery facility of claim 14 wherein the said compacting and shaping means comprises a refuse delivery chute and a chute opening having sides angled to provide a bed of refuse on the said refuse mass support surface which is approximately three feet in depth and the lateral sides of the said refuse mass being angled away from the sides of the incinerator side walls.

16. A process for the incineration and selective collection of recyclable materials in a trash mass comprising;

(a) loading the trash mass on transport means comprising a refuse support surface having means to allow removal of melted components from the refuse mass;

(b) transporting the refuse mass into a combustion zone portion of the incinerator wherein heat is provided in excess of the heat of combustion of the refuse mass to promote combustion of the combustible portions of the refuse mass;

(c) zonally separating the melted portions of the refuse mass as the melting point of specific portions of the refuse mass is reached by providing means in the refuse support surface to allow the gravity removal of the said melted portion;

(d) collecting the melted portions of the refuse mass for further processing; and (e) providing means to remove the non-combustible portions of the refuse mass having melting points above those reached in the process.

17. The process of claim 16, wherein the temperatures reached during the zonal separation of the melted portions of the refuse mass range from about 1000 degrees F. to about 2200 degrees F.

18. The process of claim 16, wherein the said support surface comprises a refractory surface having an opening to allow the gravity flow removal of melted components of the refuse mass from the said surface.

19. The process of claim 18, wherein the said surface is sloped inwardly toward the opening to promote flow of the melted components of the refuse mass.

20. The process of claim 16, wherein means are provided to promote flow of the combustion gases generated into the higher temperature zones of the incinerator to promote cleansing of the effluents by high temperature oxidation of entrained particulate material and toxic vapors.

21. The process of claim 16, wherein the heat generated in the process is utilized by recycling a portion of said heat to the process and conveying a portion of the heated gases to heat transfer means.

22. The process of claim 16, wherein the loading means for the trash refuse provides a compacted and shaped trash mass to the refuse support surface.

23. The process of claim 16, wherein means are provided to replace inoperative refuse support surfaces.

* * * * *